US009227122B2

(12) United States Patent
Jakubowski

(10) Patent No.: US 9,227,122 B2
(45) Date of Patent: Jan. 5, 2016

(54) GAME SYSTEM AND METHOD FOR HITTING A BALL THROUGH A PLAYING FIELD

(76) Inventor: Jeffrey L. Jakubowski, Waupaca, WI (US)

( * ) Notice: Subject to any disclaimer, the term of this patent is extended or adjusted under 35 U.S.C. 154(b) by 0 days.

(21) Appl. No.: 11/971,211

(22) Filed: Jan. 8, 2008

(65) Prior Publication Data

US 2009/0033034 A1 Feb. 5, 2009

Related U.S. Application Data

(60) Provisional application No. 60/927,108, filed on Apr. 30, 2007.

(51) Int. Cl.

| | |
|---|---|
| ***A63B 67/00*** | (2006.01) |
| ***A63B 69/36*** | (2006.01) |
| *A63B 63/00* | (2006.01) |
| *A63B 63/08* | (2006.01) |
| *A63B 67/02* | (2006.01) |

(52) U.S. Cl.

CPC ..... *A63B 67/002* (2013.01); *A63B 69/3691* (2013.01); *A63B 63/00* (2013.01); *A63B 63/004* (2013.01); *A63B 63/08* (2013.01); *A63B 67/02* (2013.01); *A63B 2243/0004* (2013.01); *A63B 2243/0008* (2013.01); *A63B 2243/0016* (2013.01); *A63B 2243/0083* (2013.01)

(58) Field of Classification Search

CPC ..... A63B 67/002; A63B 67/02
USPC ..... 273/398–402; 473/150–197, 409
See application file for complete search history.

(56) References Cited

U.S. PATENT DOCUMENTS

| | | | | |
|---|---|---|---|---|
| 1,419,554 | A * | 6/1922 | Ganse | 273/400 |
| 1,532,186 | A * | 4/1925 | Klein | 273/340 |
| 4,037,837 | A | 7/1977 | Bauer | |
| 4,145,048 | A * | 3/1979 | Basil | 273/400 |
| 4,805,583 | A * | 2/1989 | Mosser | 124/20.1 |
| 4,911,443 | A | 3/1990 | Foster | |
| 4,928,973 | A | 5/1990 | Perry | |
| 4,988,105 | A | 1/1991 | Perry | |
| 5,211,394 | A | 5/1993 | Jackson | |
| 5,395,122 | A * | 3/1995 | Kraemer | 273/400 |
| 5,419,561 | A * | 5/1995 | Weber | 473/409 |
| 5,516,108 | A * | 5/1996 | Foster et al. | 473/176 |
| 5,692,979 | A * | 12/1997 | Jones | 473/470 |
| 5,722,907 | A | 3/1998 | Paulun | |
| 6,412,780 | B1 | 7/2002 | Busch | |
| 6,916,250 | B1 * | 7/2005 | Ricigliano | 473/169 |
| 6,955,611 | B2 | 10/2005 | Kimmel | |
| 6,988,964 | B2 | 1/2006 | Buckfield | |
| 7,063,623 | B2 * | 6/2006 | Wengert | 473/131 |
| 7,101,293 | B2 | 9/2006 | Tarng | |
| 7,121,963 | B2 * | 10/2006 | Corbin et al. | 473/410 |
| 2007/0077974 | A1 | 4/2007 | Beaudry | |

* cited by examiner

*Primary Examiner* — Mark Graham
(74) *Attorney, Agent, or Firm* — Steven H Greenfield; Greenfield Invention and Patent Consulting, Inc.

(57) ABSTRACT

The present invention is directed to a game, and more specifically to an outdoor game designed for two or more players that requires navigating a large playing field containing a variety of objects and obstacles. The players navigate the course by hitting a ball with a bat over, through or around the objects while avoiding the obstacles. The starting line, the end line, the game course, the rules for the game and the point system to decide the winner are determined and communicated to the players prior to the game. In the preferred embodiment of the present invention, the player reaching the end line with the fewest strokes is awarded the win. The preferred playing field is a golf course.

19 Claims, 6 Drawing Sheets

GAME SYSTEM AND METHOD FOR HITTING A BALL THROUGH A PLAYING FIELD

RELATED APPLICATIONS

This application claims priority from provisional application No. 60/927,108 filed on Apr. 30, 2007.

FIELD OF THE INVENTION

The present invention relates to an outdoor game for two or more players that combines elements of the games of baseball and golf. From a preset starting point, each player moves a ball through a playing field by hitting it with a bat multiple times until the player reaches a preset end point. The field comprises of a variety of objects and obstacles through which the player must navigate. The player who reaches the end line having the fewest hits wins the game

BACKGROUND OF THE INVENTION

The game of golf is very popular in the US as well as worldwide, but is fairly expensive to play. Golf courses require large areas of land which are scarce and costly especially in large metropolitan areas. Golf courses built in rural areas are less expensive to build but, for many golfers, typically require time consuming and expensive travel to get to. Golf can be played year round in warm climates but the playing season in northern regions can be as short as four months or even less. Thus many golf courses in these regions attempt to pack a very tight schedule during the playing season, but are abandoned come November. One solution devised to meet the demand for golf at lower costs includes designing smaller courses where a limited version of golf can be played, such as miniature golf. Another solution described in the prior art relates to the design of modified games that include elements of the game of golf along with those of other games, such as basketball or Frisbee. These games can typically be played on fields that are more available and thus less expensive, and/or may be played on a golf course during part of the off-season.

Several prior art references disclose games that constitute modifications of the game of baseball or the game of golf, or games that combine fields, setups and rules of two or more known games. U.S. Pat. No. 4,988,105 is directed to a novel golf playing field for a golf-like target game. Although the playing field incorporates many of the features of standard golf including golf clubs, golf balls, a fairway, teeing areas, a sand trap, a putting green and target greens, the present invention is not an attempt to faithfully simulate a standard round of golf. Basically, the invention includes a playing field comprising a course with a fairway and a plurality of target greens positioned thereon in a predetermined pattern. U.S. Pat. No. 7,101,293 teaches a game referred to as golh which uses a golh club, golfrisbee disc and golfrisbee basket. Swivelling the golh club, the flying object such as golfrisbee disk is thrown to fly into the golfrisbee basket. The golfrisbee basket has the wind-bell-chain reverted umbrella structure to protect the golfrisbee from damage. Golh is a hybrid golf comprising the flying golfrisbee and golf ball. Basedisc is the golfrisbee sport following the similar game rules of baseball. The core technologies are the swivelling club throwing technology, wind-bell-chain reverted-umbrella golfrisbee basket and the universal direction wing flying disk technology. U.S. Pat. No. 5,211,394 discloses a playing field that utilizes a conventional baseball diamond includes, beginning at the back of the infield, arcuate segments lined off in the outfield to create scoring zones. The last line or the field's boundary fence is the home run zone. Additionally, a plurality of vertical hoops is placed at selected locations in the playing field with the opening of the hoop facing home plate. Hitting through the hoops could award the hitter additional score points. U.S. Pat. No. 5,722,907 relates to an athletic field and outdoor game played thereon. The game uses bats, mitts, and a ball on a rectangular playing field where each team attempts to score points by hitting the ball into the other team's end zone. U.S. Pat. No. 6,988,964 refers to a game and, more specifically, to a game that utilizes throwing rings and balls. A number of games exist that test the skill of a player to direct throwing rings or balls in relationship to other objects. For example, such games as lawn bowling, horseshoes, bocce ball and croquet utilize at least one of the above-referenced components. The above-described games require skill and practice to develop one's game but, in general, requires little strategy.

SUMMARY OF THE INVENTION

In one aspect, the game of the present invention is a unique and challenging combination of skill, accuracy and strategy. The game requires hitting a ball with a baseball bat, a cricket bat, a racket or a paddle multiple times around, over, or through a marked course, while avoiding a number of obstacles and navigating the course as marked. The game also requires the player to plan and strategically place the ball in locations on the playing field that would put him or her in the best position for a win. In another aspect of the present invention, a form of a baseball game is played on a course similar to a golf course using game rules similar to those of the game of golf. In yet another aspect, the game of the present invention is designed to have a great deal of flexibility in setting up the field and the rules of the game. None of the prior art games combines the setup within a golf course and hitting a baseball using the game rules of the present invention.

The preferred set up for this game is a large field that has a varied topography including trees, bushes, hedges, thick brush, flat areas, moderately hilly terrain, small ponds, small streams, grassy areas, and paved areas as well as sandy and dirt areas. A golf course is an example of a desirable field for this game as it generally contains natural objects and obstacles needed to play the game of the present invention. Many of the existing objects on a golf course including trees, rocks, structures, and buildings are useful for playing this game. Additional objects may be set up at various locations on the playing field including walls, fences, barrels, goal posts, hanging rings, gongs and poles that can serve as targets for a player to navigate through with the ball. The preferred playing field also comprises natural obstacles such as a stream, small lakes or ponds, and thick brush that challenge the players to maneuver around without losing the ball. Some farm and wooded fields may also have the desired topography and contain many of the objects needed for playing the game. Alternate fields that may be suitable for playing the game of the present invention include areas used for skiing, race tracks, baseball fields, soccer fields and football fields. The fields that span over a relatively small area may still be suitable for a more limited version of this game. Such fields, to the extent that lack natural objects and obstacles, would require setting up with various artificial objects and obstacles needed to play the game.

Each player, at his or her turn, tosses up the ball and hits it with a bat. The player must take the next hit from the spot where the ball stops. Following the course as mapped out, the players will be hitting their ball around, over or through the marked objects, adding every hit or stroke to their stroke count. If a player's ball goes the wrong way around the marked object, he or she will need to hit their ball back and go around the object the way it was marked out. Likewise, the player will want to steer away from the obstacles dispersed across the playing field, since losing the ball in an obstacle will also result in point penalties. The player completing the course with the fewest hits is awarded the win.

The present invention discloses the game system and method for playing this game hence referred to as JaBaolf.

It is the object of the present invention to provide a game that has similarities to golf but is more user-friendly in that it does not require expensive equipment, and can utilize a field or course that requires less maintenance than a golf course. The game can be played on a golf course during part of the off season before the fields are covered with snow as JaBaolf does not require a well manicured grass on the fairways or around holes. It is in fact preferable for the game to utilize the areas peripheral to the course where the natural objects and obstacles such as tree clusters, bushes, streams, ponds, lakes, and building structures are typically found.

It is also the object of the present invention to provide a challenging game that combines the skill of hitting a ball with a bat, which is characteristic of a baseball game, with aiming the ball toward a target while avoiding obstacles which are characteristic of a golf game. JaBaolf can be played on playing fields other than golf courses, and can also be played on golf courses during some of the off season. It is further the object of the present invention to provide an outdoor game that may be enjoyed by most age groups. The preferred field has an area between five and thirty acres, and the playing course length between a quarter and four miles.

DETAILED DESCRIPTION OF THE INVENTION

Figure 1A:
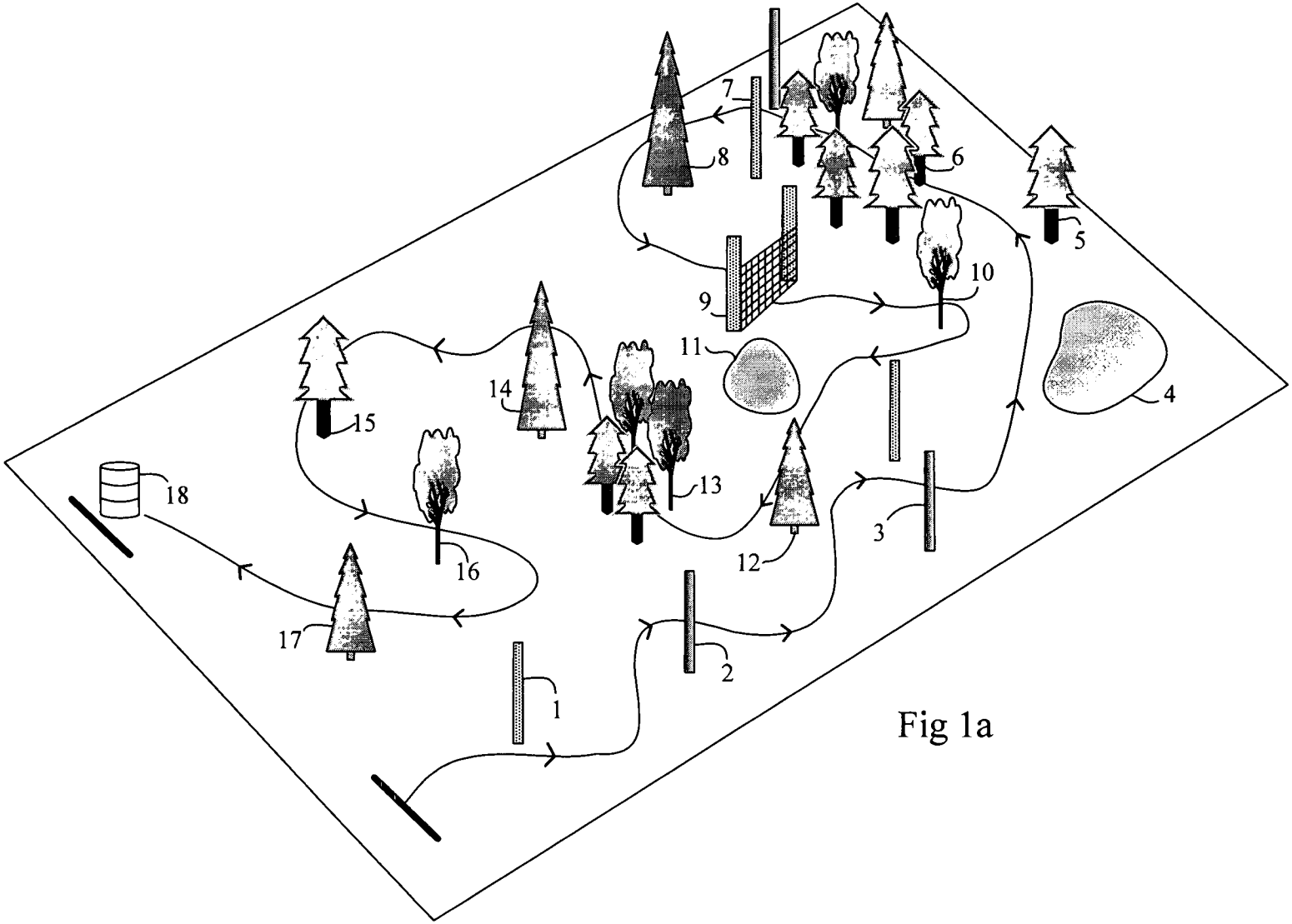
FIG. 1*a* represents one embodiment of a game course map as provided to the players before the game and an illustration of a playing field layout and progression of the JaBaolf game.

Before the start of the game, the designated game director in charge of arranging the course provides a map of the field layout to each player showing the various objects through which the players will need to navigate, a chart of the game progression route, the obstacles, and the rules for the game including the point system. Additionally, the length of the course and clearly marked boundaries for the playing field are provided. For example, course XYZ runs 1.3 miles with 28 objects and course ABC has a length of 0.6 miles and 14 objects. The objects are numbered sequentially. Color coded markers, such as flags or poles are placed next to the objects to indicate the direction of game progression. For example, an orange marker indicates that the ball must be hit to the left of the marked object, while a yellow marker indicates that the ball must be hit to the right of the marked object, e.g., the marked tree or pole.

As a general rule, every time a player hits the ball, a stroke is added to the count. The player with the lowest stroke count wins. A number of the objects provide opportunities to reduce stroke count. For example, the player may have the option of hitting the ball between two trees instead of over them for a one point reduction in stroke count. Likewise, two poles spaced ten to twenty feet apart may have two poles spaced only two feet apart right behind them. If the player manages to hit the ball between the poles spaced two feet apart, he or she will be awarded a two to five point reduction in the hit count, while no reduction is awarded to the player hitting through the more widely spaced poles. Another example is a wall having about a two by two to about a four by four foot opening. The player has the option of hitting the ball over the wall without a point reduction in the stroke count, or hitting the ball through the opening for a one or two point reduction in the stroke count. Other opportunities for point reduction include hitting the ball through a hanging ring, hitting a gong, and hitting the ball into an open top barrel. A player adds one stroke to the count if he or she loses the ball into a pond, a lake, a stream or hits it out the bounds of the playing field.

The game is designed for two to eight players. In the preferred embodiment of the game rules, each player is given a baseball bat and a softball onto which his or her name is inscribed or otherwise marked for identification. It should be understood, however, that several types of batting implements including wooden or metal round bats of various thicknesses, length, weights or even flat shaped bats, such as cricket bats, paddles and rackets also fall within the scope of this invention. While the preferred balls for the game are softballs, other hard and soft balls such as hard baseballs, cricket balls or tennis balls also fall within the scope of this invention. If a hard ball is used, the players might be required to wear helmets and other safety gear for protection.

Each player begins the game from the same designated starting line. The players determine the batting order and appoint a score keeper who may or may not be the course director. From the starting point, each player, at his or her turn, tosses up the ball and hits it towards the first marked object. Several of the objects might be reachable with only one hit or stroke, but two or more strokes may be required to reach other targets. In the preferred embodiment of the game rules, the player must hit the ball from the spot where the ball stops from the previous hit, if the ball continues to roll after landing. Therefore, the player will want to aim the ball toward a place on the field calculated to put him or her in the best position to move on towards the next object. If the player hits the ball off the charted route, he or she must hit the ball back to return to the charted course. This would add to the player's stroke count. If a hit ball falls onto a spot that gives the player very little space for the next hit, he or she may take one clearance step from the location of the ball to gain additional room for hitting. A clearance step may only extend to where the player can stretch his/her leg without jumping or using his/her hands for assistance. A clearance step may only be taken to the side or backward, but not forward, and only one clearance step per hit is permitted. A limit of clearance steps per player per game may be decided on by the players or the course director.

Obstacles also referred to as hazards, include ponds, streams, thick brush, thick hedges and lakes. The general rule is that if the ball falls in a pond or stream the player will be provided with a new ball, and an alternate nearby location around where the ball entered the hazard will be determined for the next hit. One stroke will then be added to the player's count. Likewise, if the ball is hit outside the boundaries of the playing field, the ball will be brought back to the spot where the ball exited the field and used for the next hit. A stroke will be added to the player's count as well.

The last object on the game course will generally be the most challenging and provide the players with the last opportunity to reduce stroke count. Such an object may be an open top barrel, a gong, a hanging ring, a wall that has a two foot to a four foot opening, or a hole in the ground. A direct hit on the gong, hitting through the ring, or hitting the ball into the barrel will deduct three points from the total stroke count for the player. The player has only one chance to get the last object bonus. If the ball hits the barrel instead of falling in, or has passed the object, that chance is lost. The player may not backtrack, and the game is over for this player.

Following is a summary of the one embodiment of the game rules given to the players.

Object of the Game

Players start out at the marked beginning. Two to eight players per group works best. Using a bat of your choice, you hit your marked softball or baseball after pitching it up to yourself; that is you toss it up and hit it. You take your next hit from where your ball has stopped. Players will be hitting their ball around, over, through or against specified objects in the course similar to a golf course. An appointed score keeper will be counting the total strokes or hits it takes to complete the course. The person with the fewest strokes or hits wins.

Players will be hitting some long distance drives, some short distance drives and also hitting for accuracy through, around, over or against objects marked on the course. Players must make it through the course as laid out. If a player's ball goes to the wrong side of a given marker, he/she must bat their ball back and go around the marker the right way adding the extra hits to their count.

Rules & Description

1. The course should be laid out and clearly marked as in the course map on the next page. Every course will be different, presenting its own challenges like a Golf course would.
2. Player Equipment needed—Bats of various lengths, weights and shapes (round or with flat sides) can be used. Players can use different bats during the course to adjust to the type of hitting needed. Balls can be regular baseballs, softballs or tennis balls of various sizes. We recommend a standard 12 inch softball. All balls should have the players name or an identifying mark on them. This will eliminate any confusion regarding ball ownership when more than one ball is hit into the same area.
3. Starting off—Everyone starts at a given point and players determine the batting order. Appoint one person to be in charge of keeping everyone's score. After everyone in the group bats, let the player that falls behind or goes the wrong way take the extra strokes/hits needed to keep up with the group.
4. Batting—Balls must be hit while in the air by pitching it up to one self. Hitting off the ground or having someone else pitch the ball to you is not allowed. Where the ball stops from the previous hit, is where you take your next hit. The player will pick the ball up and place one foot where the ball was and can pivot from that point to take their next hit. The score keeper should be marking down every hit taken by each player.
5. Following the Course—Batting the ball to a given object or marker you will have to go through, around, over or hit before moving on. With a course map showing the course direction to be played and describing the markers and which way you are required to go through or around. If a player's ball goes the wrong way around an object or marker they must hit their ball back and go the right way as described by the course. The hits they take to get back on course will be added to their score total.
6. Clearance Steep—is a step taking to move away from an object such as a tree, a shrub or a wall for swinging room. A step can be as long as the player can stretch their legs without jumping or using their hands for assistance. Clearance step can only be taken to the side or backwards, never advancing forward. Usually one Clearance step per occurrence is allowed. A given amount of Clearance steps allowed per course can be set by the players or course director.
7. Color Coding—The Course works best if you establish a color code to mark the course out with. Similar to the way a boat would navigate through a water way with colored buoys. For Example; An Orange pole or marker (Tree) on the course the ball would need to go to the right side of. A Yellow pole or marker (Tree) the ball would need to go to the left side of. If the Yellow and Orange markers are parallel the ball must be batted between them.
8. Out of Bounds—If there are boundaries set in place, these boundaries will be marked on the map. If a ball goes out of bounds, the Player must bring the ball back to the point where it first went out and play it from there. The player's foot is placed at that point to continue with the next hit. A one penalty hit is added to their score for going out of bounds.
9. Ending the round—The last object to end the round is usually something round you hit the ball into or against. A plastic 55 gallon barrel with an open top works well. A course can make this anything they like to make it challenging. (Hanging Ring, Wall, Gong, Hole in ground etc.). The barrel is preferable because it is portable. If the player hits the ball into the inside of the open drum, 3 hits are taken off his stroke count. Once the player's ball hits the drum, he or she have finished the game and cannot try for the bonus.
10. Bonus Hits—are added challenging targets or objects that can be place in any JaBaolf course to give the player's bonus hits, which are hits taken off their ending score. But once a player's ball goes beyond the bonus mark they cannot hit or reach back to get the bonus. Bonus hits per target or opening should be set by the course director and marked on the course map.

Bonus Example—a wall they have to hit over has a 2-4 ft hole in it. Another idea is having an opening between 2 main poles or markers spaced 10-20 feet apart they have to go through with another set of poles inside of the main poles or markers 1-2 feet apart for a bonus. The player would receive a bonus of 2-5 hits taken off their score if they make it through the bonus target or narrow opening.
11. Winning—The player to finish the course with the least amount of Strokes or Hits is the winner.

Figure 1B:
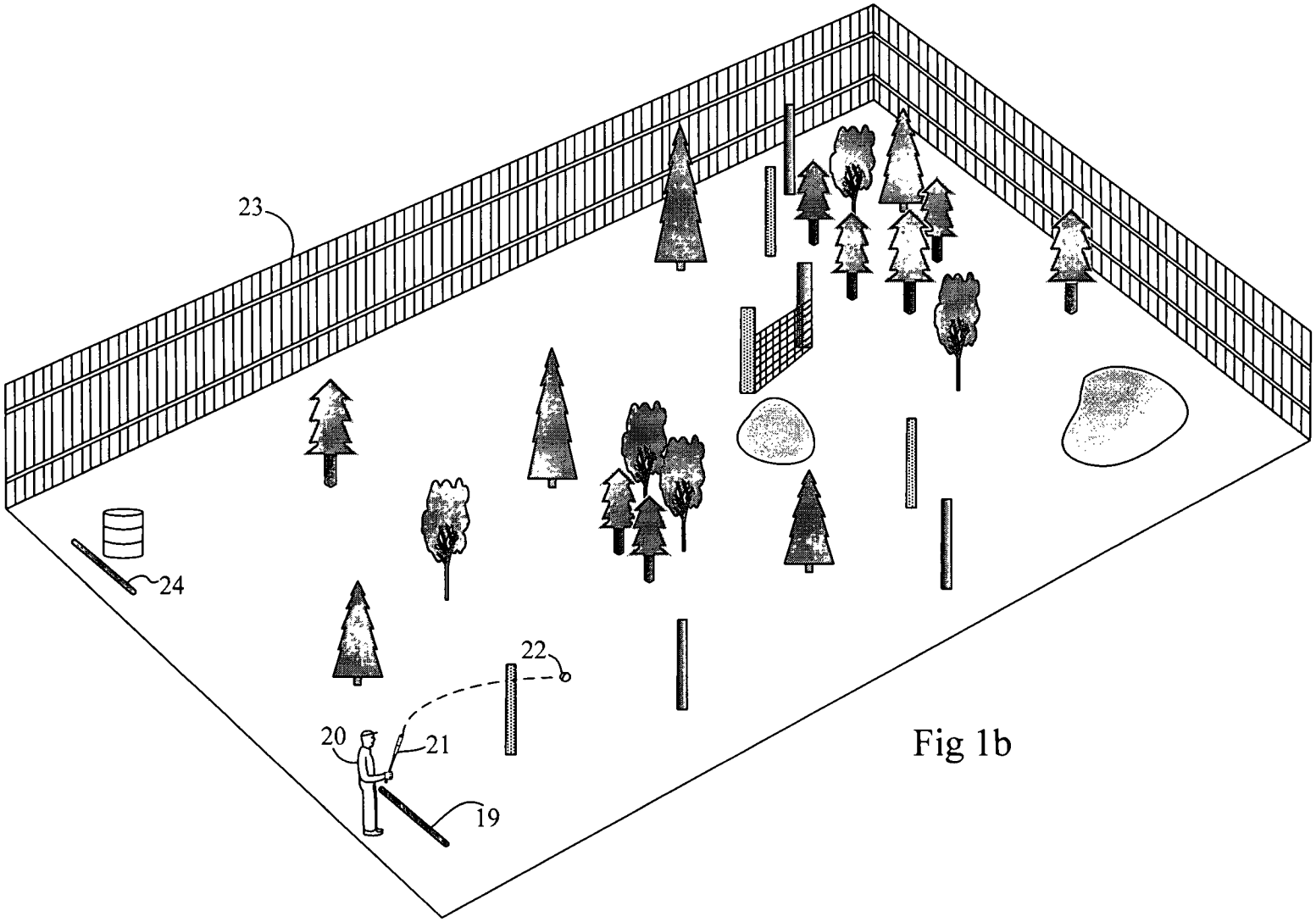
FIG. 1*b* shows the player hitting a ball with a bat at the starting line of the field shown in FIG. 1*a* and also indicating objects not typically marked on the course map.
Figure 2:
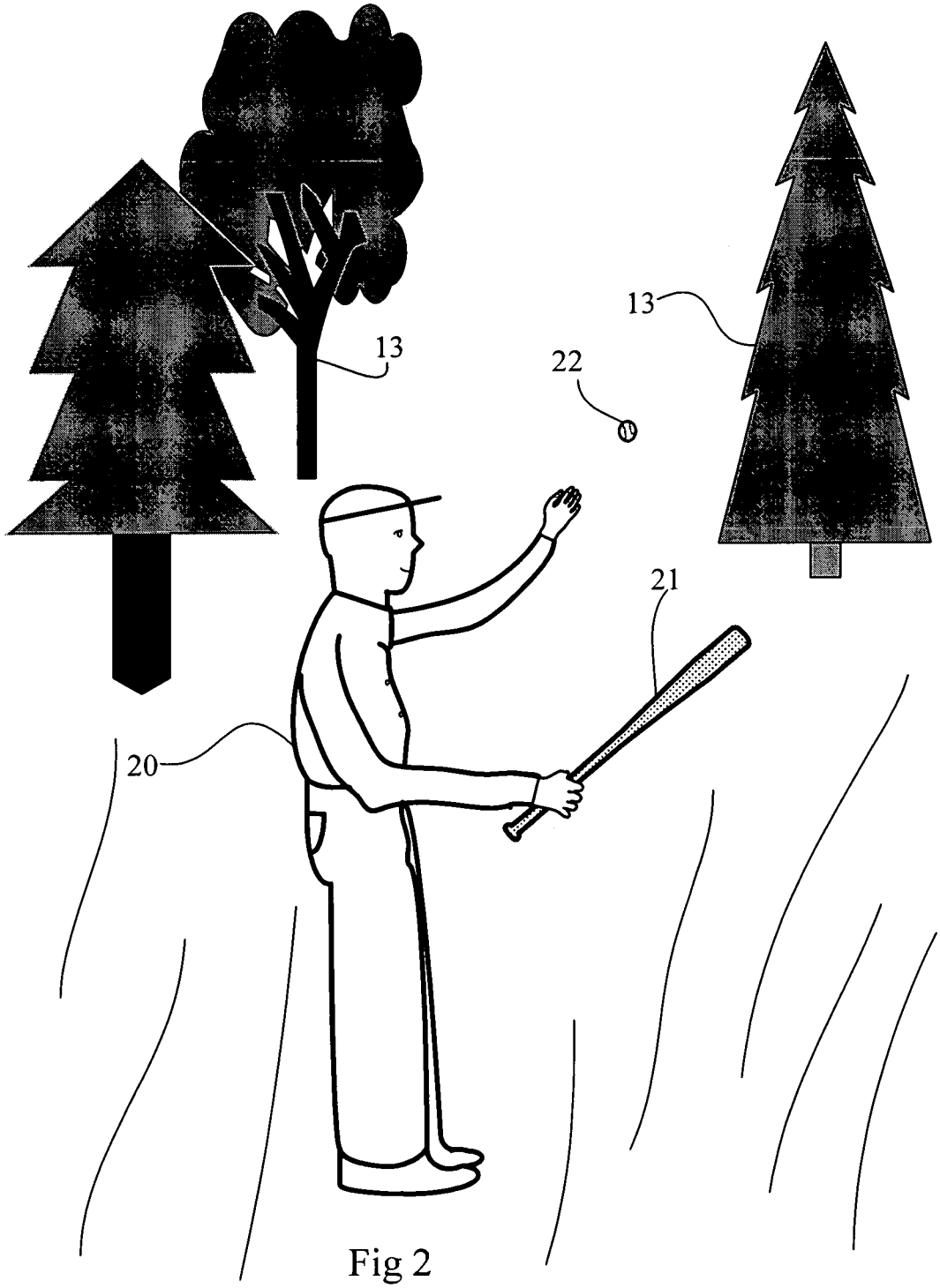
FIG. 2 depicts a player hitting a softball with a baseball bat between two trees.
Figure 3:
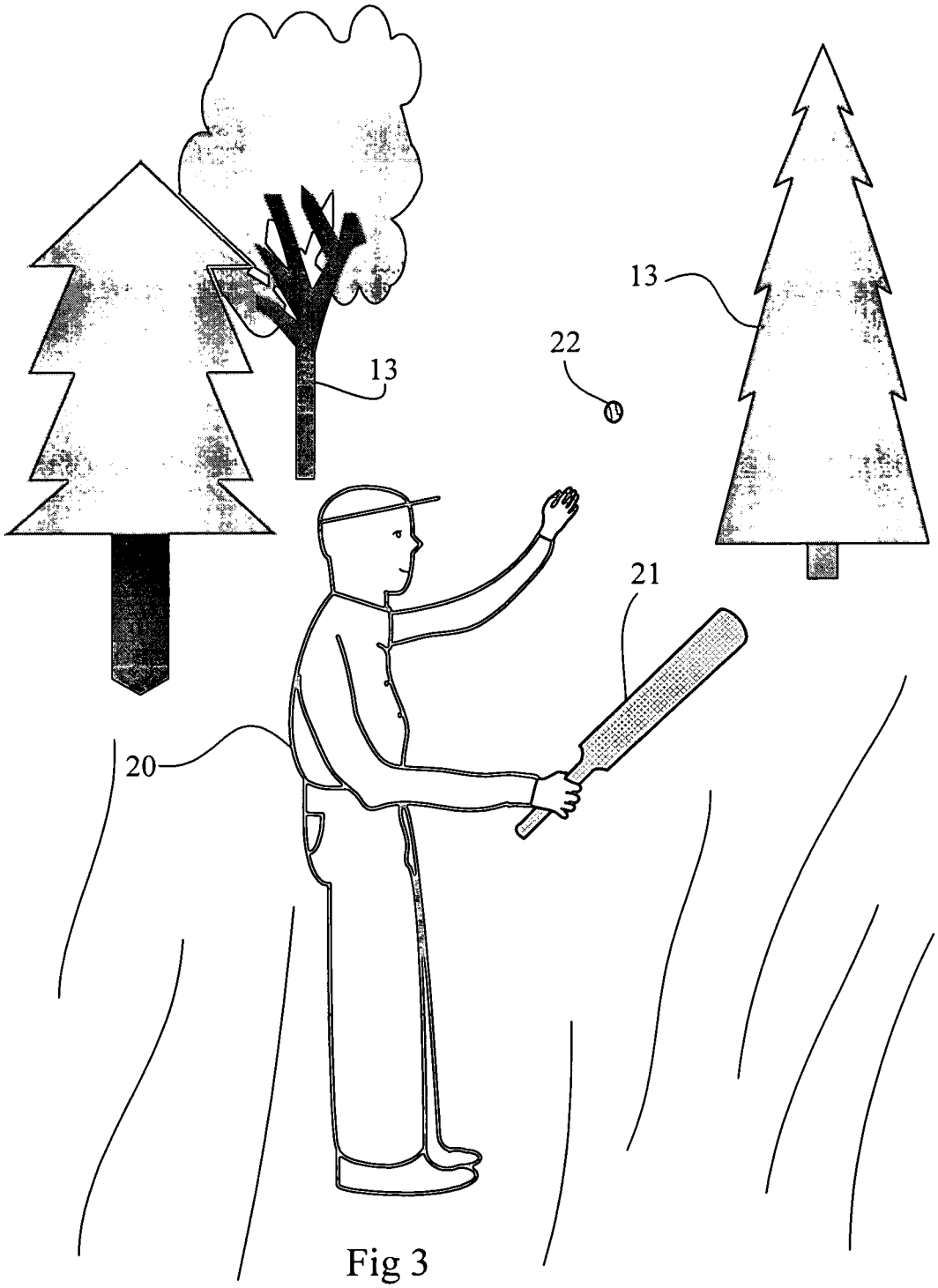
FIG. 3 shows a player hitting a softball with a cricket bat between two trees.
Figure 4A:
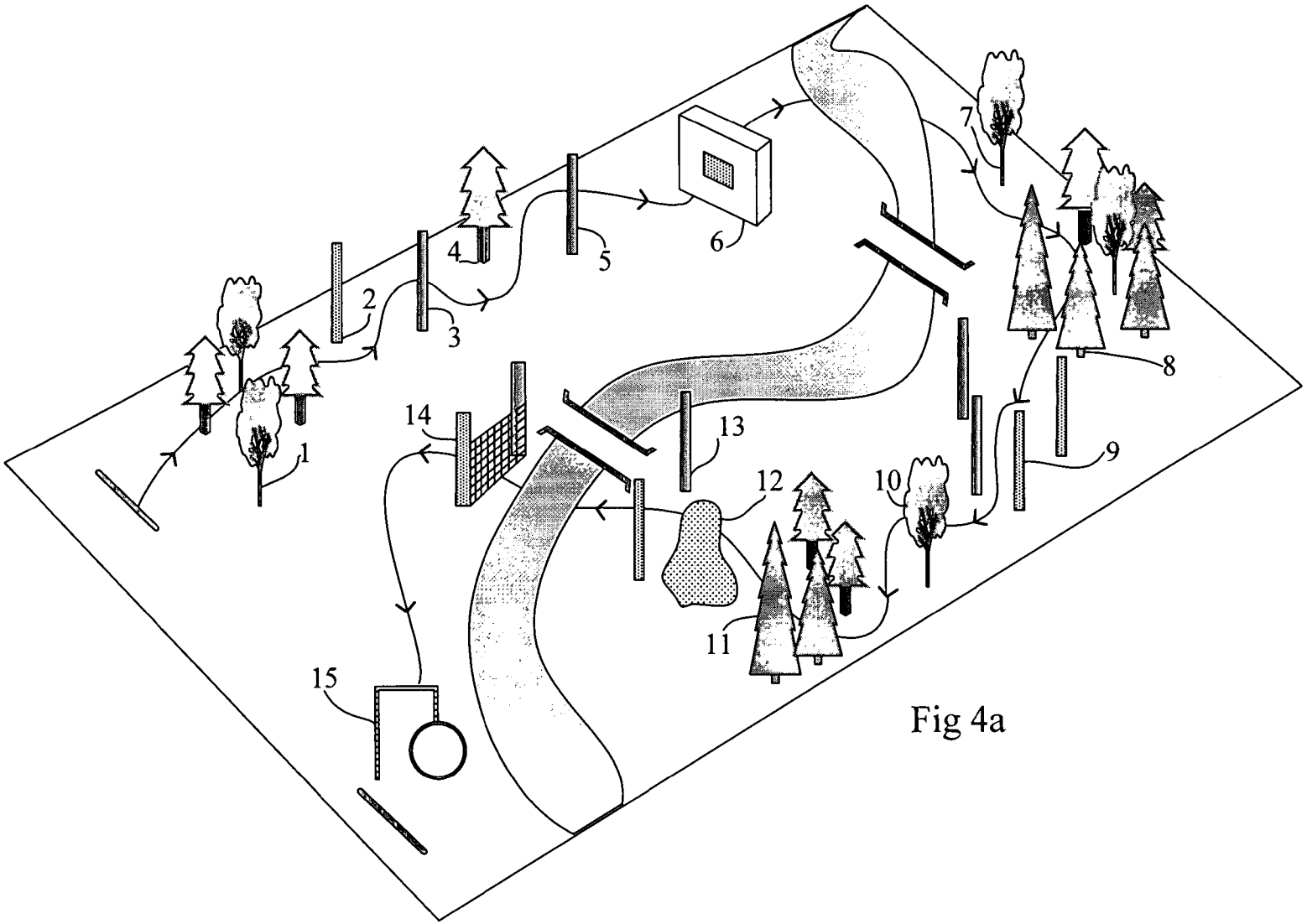
FIG. 4*a* is an alternative embodiment of a game course and setup of the field for playing the JaBaolf game.
Figure 4B:
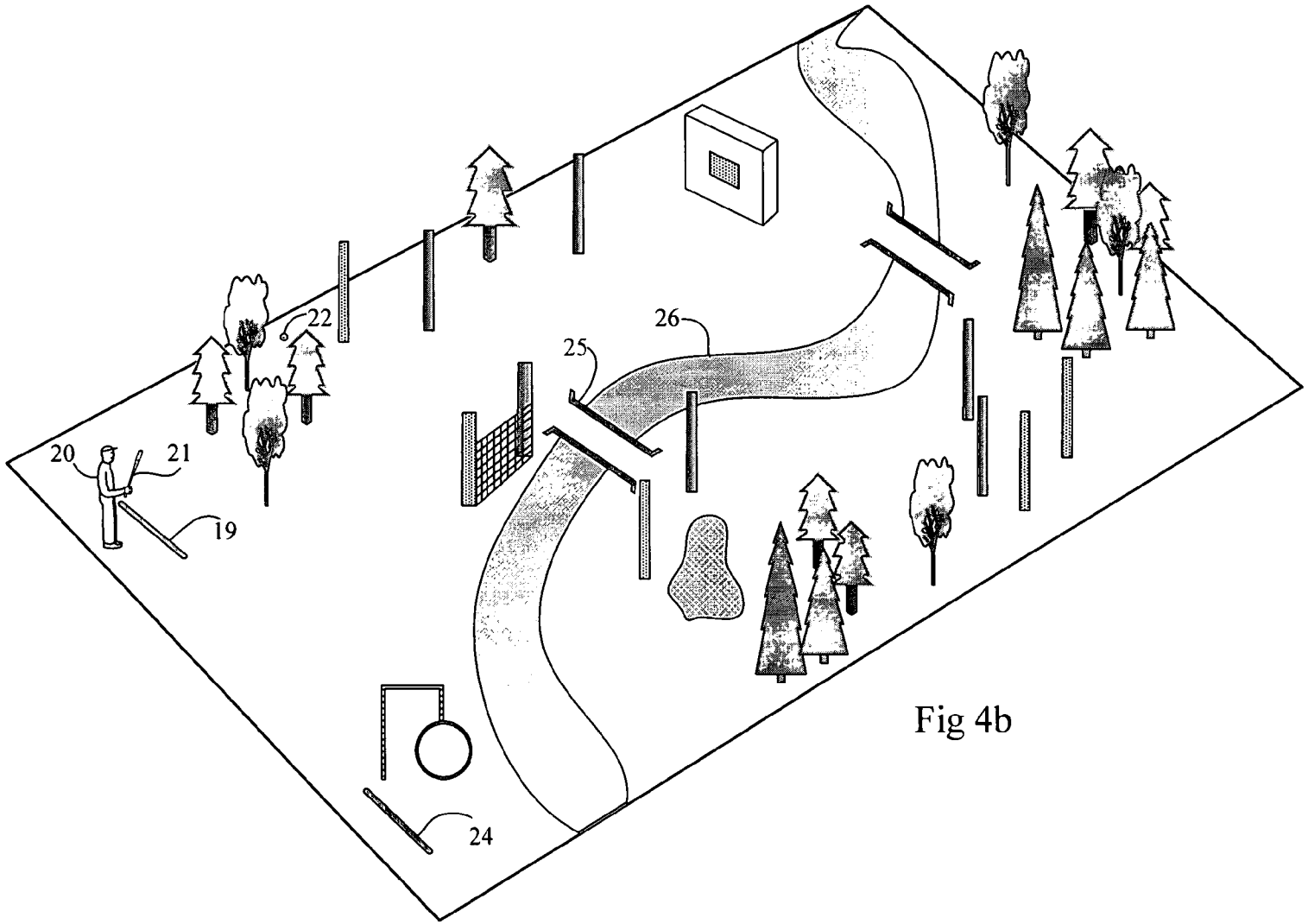
FIG. 4*b* shows the player hitting a ball with a bat at the starting line of the field shown in FIG. 4*a* and also indicating objects not typically marked on the course map.

Referring to FIG. 1*a*, the course map displays a pole 1 that requires the player to navigate to the right of it, followed by a pole 2 that the player has to hit to its left. The next object consists of a pairs of poles spaced about ten feet apart 3. The player must hit through this pair of poles. Next, the player needs to navigate around a pond 4 without losing the ball into it. Hitting the ball into the pond will result in a one point increase in the player's stroke count. Following a tree 5 marked for passing to its left, the player comes to a cluster of trees 6 the player has the option of hitting through or over. Hitting through is more challenging to the player but also more advantageous, since he or she is awarded a one or two point reduction in the stroke count. Immediately following the cluster of trees 6, is a pair of poles 7 the player must hit through. In this spot close to the playing field border, the player should attempt to steer clear of hitting the ball out the playing field bounds to avoid an increase in stroke count. The objects that follow are a tree 8 to the left of the game path, a fence 9 the player must hit over, a tree to the right of the game path 10, a pond 11 to the right of the game path around which the player needs to maneuver taking care not to hit the ball into, a tree to the left of the game path 12, a cluster of trees 13 providing the player the option to hit over or through for a point reduction in stroke count, a tree to the left of the game path 14, another tree to left of the game path 15, a tree to the right of the game path 16, and another tree to the left of the game path 17. The last object on the course is an open top barrel 18 that presents the player an opportunity to shave three points off his or her total count by hitting the ball into the barrel. FIG. 1*b* is the field of FIG. 1*a* showing the starting line 19, a player 20 holding a bat 21 having hit the ball 22 for the first time onto the game path, and the end line 24. The playing field is bordered by a fence 23. Referring to FIG. 2, a player 20 is shown tossing up a ball 22 ready to hit it with a baseball bat 21 between a cluster of trees 13. FIG. 3 shows the player of FIG. 2 hitting the ball with a cricket bat 21. The course layout of FIG. 4*a* starts with a cluster of trees 1 followed by a pole to the left of the game trail 2, a pole to the right of the trail 3, a tree to the left of the trail 4, and a pole to the right of the path 5. The next object is a wall with an opening 6 that provides the player a chance to reduce his or her stroke count by hitting the ball through the opening instead of over the wall. The player must next hit over a small stream, navigate past a tree to the left of the trail 7, a cluster of trees 8, two pairs of poles 9, one spaced ten feet apart followed by a pair of poles spaced only two feet apart, past a tree 10 to the left of the trail, another cluster of trees 11, a large rock to the left of the trail 12, over the stream, and over a fence 14. The player needs to take care not to hit the ball into the stream in order to avoid a penalty point. The final object is a hanging ring 15 that can reduce the player's stroke count by three points if he or she hits the ball through the ring. FIG. 4*b* illustrates the field of FIG. 4*a* having a stream 26 with two pedestrian bridges 25 that cuts through the field, and showing the player 20 hitting a ball 22 from the starting line 19. The end line 24 is behind the hanging ring.

What is claimed is:

1. A method for playing a game with multiple players wherein a player having the fewest points wins the game, said method comprising the steps of:

providing a playing field having a preset beginning line, having a preset end line, having a preset course and having preset boundaries;

positioning a player at a predetermined distance from a first pole disposed on the playing field;

said player pitching a ball substantially vertically upward and hitting said ball with a hitting implement as said ball descends, said player targeting the ball to pass by a right side of a first pole and in a direction of a second pole such that the ball falls on a spot on the ground disposed on a path between the first and the second pole;

said player picking up the ball, and, while standing at a spot on the ground disposed between the first and the second pole where the ball has fallen after passing by the right side of the first pole, tossing said ball substantially vertically upward and hitting said ball as said ball descends, said player targeting the ball to pass by a left side of the second pole and in a direction of a first pole-set having a first border and a second border resulting in the ball falling on a spot on the ground disposed on a path between the second pole and the first pole-set;

said player picking up the ball, and, while standing at a spot on the ground disposed between the second pole and the first pole-set where the ball has fallen after passing by the left side of the second pole, tossing said ball substantially vertically upward and hitting said ball as said ball descends, said player targeting the ball to pass between the first border and the second border of the first pole-set and in a direction of a second pole-set having a first border and a second border resulting in the ball falling on a spot on the ground disposed on a path between the first pole-set and the second pole-set;

said player picking up the ball, and, while standing at a spot on the ground disposed between the first pole-set and the second pole-set where the ball has fallen after passing the first pole-set, tossing said ball substantially vertically upward and hitting said ball as said ball descends, said player targeting the ball to pass between the first border and the second border of the second pole-set and in a direction of a fence resulting in the ball falling on a spot on the ground disposed on a path between the second pole-set and the fence;

said player picking up the ball, and, while standing at a spot on the ground disposed on the path between the second pole-set and the fence where the ball has fallen after passing the second pole-set, tossing said ball substantially vertically upward and hitting said ball as said ball descends, said player targeting the ball to pass over the fence and in a direction of an end target resulting in the ball falling on a spot on the ground disposed on a path between the fence and the end target; and said player picking up the ball, and, while standing at a spot on the ground disposed between the fence and the end-target where the ball has fallen after passing the fence, tossing said ball substantially vertically upward and hitting said ball as said ball descends, said player aiming to hit the end-target.

2. The method of playing the game in claim 1, wherein the hitting implement is selected from the list consisting of a baseball bat, a cricket bat and a tennis racket.

3. The method of playing the game in claim 2, further comprising increasing the point count by at least one point for each hit, hitting the ball outside the preset boundaries of the field, taking a clearance step, hitting the ball into a lake, hitting the ball into an inaccessible location or losing the ball and turning back on the course.

4. The method of playing the game in claim 1, wherein said end target is selected from the list consisting of an open top barrel, a gong, a hanging ring, a wall having a one foot to a four foot opening, and a hole in the ground.

5. The method of playing the game in claim 4, further comprising reducing the point count by at least one point for hitting the ball through a tree cluster, hitting the ball through the opening in the wall, directly hitting the gong, hitting the ball through the hanging ring and hitting the ball into an open top barrel.

6. The method of playing the game in claim 1, further comprising said player picking up the ball and, while standing at a spot on the ground between first pole-set and the second pole-set where the ball has fallen after passing the first pole-set, tossing said ball substantially vertically upward and hitting said ball as said ball descends, said player targeting the ball to pass over a first body of water, said body of water being disposed on a path between the first pole-set and the second pole-set.

7. The method of playing the game in claim 6, further comprising said player picking up the ball and, while standing at a spot on the ground where the ball has fallen after hitting the ball over the first body of water, tossing said ball substantially vertically upward and hitting said ball as said ball descends, said player targeting the ball to pass to a left side of a first tree, said first tree being disposed on a path between the first pole-set and the second pole-set.

8. The method of playing the game in claim 7, further comprising said player picking up the ball and, while standing at a spot on the ground where the ball has fallen after hitting the ball to the left of the first tree, tossing said ball substantially vertically upward and hitting said ball as said ball descends, said player targeting the ball to pass over or through a first tree cluster, said first tree cluster being disposed on a path between the first pole-set and the second pole-set.

9. The method of playing the game in claim 8, further comprising said player picking up the ball and, while standing at a spot on the ground disposed on the path between the second pole-set and the fence where the ball has fallen after passing the second pole-set, tossing said ball substantially vertically upward and hitting said ball as said ball descends, said player targeting the ball to pass to a right side of a second tree, said second tree being disposed on a path between the second pole-set and the fence.

10. The method of playing the game in claim 9, further comprising said player picking up the ball and, while standing at a spot on the ground disposed on the path between the fence and the end target where the ball has fallen after passing the fence, tossing said ball substantially vertically upward and hitting said ball as said ball descends, said player targeting the ball to pass to a left side of a third tree, said third tree being disposed on a path between the fence and the end target.

11. The method of playing the game in claim 10, further comprising said player picking up the ball and, while standing at a spot on the ground where the ball has fallen after hitting the ball to the left side of the third tree, tossing said ball substantially vertically upward and hitting said ball as said ball descends, said player targeting the ball to pass over a second body of water, said body of water being disposed on a path between the fence and the end target.

12. The method of playing the game in claim 11, further comprising said player picking up the ball and, while standing at a spot on the ground where the ball has fallen after hitting the ball past the second body of water, tossing said ball substantially vertically upward and hitting said ball as said ball descends, said player targeting the ball to pass to a right side of a fourth tree, said fourth tree being disposed on a path between the fence and the end target.

13. The method of playing the game in claim 12, further comprising said player picking up the ball and, while standing at a spot on the ground where the ball has fallen after hitting the ball to the right side of the fourth tree, tossing said ball substantially vertically upward and hitting said ball as said ball descends, said player targeting the ball to pass to over or through a second cluster of trees, said second cluster of trees being disposed on a path between the fence and the end target.

14. The method of playing the game in claim 13, further comprising said player picking up the ball and, while standing at a spot on the ground where the ball has fallen after hitting the ball past the second cluster of trees, tossing said ball substantially vertically upward and hitting said ball as said ball descends, said player targeting the ball to pass to a right side of a fifth tree, said fifth tree being disposed on a path between the fence and the end target.

15. The method of playing the game in claim 14, further comprising said player picking up the ball and, while standing at a spot on the ground where the ball has fallen after hitting the ball to the right side of the fifth tree, tossing said ball substantially vertically upward and hitting said ball as said ball descends, said player targeting the ball to pass to a right side of a sixth tree, said sixth tree being disposed on a path between the fence and the end target.

16. The method of playing the game in claim 15, further comprising said player picking up the ball and, while standing at a spot on the ground where the ball has fallen after hitting the ball to the right side of the sixth tree, tossing said ball substantially vertically upward and hitting said ball as said ball descends, said player targeting the ball to pass to a left side of a seventh tree, said seventh tree being disposed on a path between the fence and the end target.

17. The method of playing the game in claim 16, further comprising said player picking up the ball and, while standing at a spot on the ground where the ball has fallen after hitting the ball to the left side of the seventh tree, tossing said ball substantially vertically upward and hitting said ball as said ball descends, said player targeting the ball to pass to a right side of an eighth tree, said eighth tree being disposed on a path between the fence and the end target.

18. The method of playing the game in claim 17, further comprising said player picking up the ball and, while standing at a spot on the ground where the ball has fallen after hitting the ball to the right side of the eighth tree, tossing said ball substantially vertically upward and hitting said ball as said ball descends, said player aiming to hit the end target.

19. The method of playing the game in claim 6, wherein the body of water is a lake, a stream or a pond.

* * * * *